US006834762B2

(12) United States Patent
Krisko et al.

(10) Patent No.: US 6,834,762 B2
(45) Date of Patent: Dec. 28, 2004

(54) FOLDABLE BEVERAGE CARRIER

(75) Inventors: John P. Krisko, Danbury, CT (US); Craig Martin Elvin, White Plains, NY (US); Jason Asher Bernstein, Roswell, GA (US)

(73) Assignee: Pratt Industries (U.S.A.), Inc., Conyers, GA (US)

( * ) Notice: Subject to any disclaimer, the term of this patent is extended or adjusted under 35 U.S.C. 154(b) by 0 days.

(21) Appl. No.: 10/403,166

(22) Filed: Mar. 31, 2003

(65) Prior Publication Data

US 2004/0188278 A1 Sep. 30, 2004

(51) Int. Cl.[7] ..... B65D 75/00
(52) U.S. Cl. ..... 206/162; 206/427
(58) Field of Search ..... 206/162, 163, 206/142, 143, 170–175, 180, 188, 193, 427, 784; 229/904

(56) References Cited

U.S. PATENT DOCUMENTS 2,362,995 A * 11/1944 Gilbert ..... 206/170
2,565,449 A * 8/1951 Emrick ..... 206/189
3,565,323 A * 2/1971 Katzenmeyer ..... 229/117.14
4,678,154 A 7/1987 McFarland
4,979,657 A 12/1990 Espiritu
5,738,217 A 4/1998 Hunter
5,927,502 A 7/1999 Hunter
6,202,836 B1 * 3/2001 Picciolo ..... 206/194
6,230,881 B1 5/2001 Collura
6,230,882 B1 5/2001 Wischusen, III
6,457,772 B1 10/2002 Forston
6,536,656 B2 3/2003 Auclair et al.

* cited by examiner

*Primary Examiner*—Jacob K. Ackun
*Assistant Examiner*—J Williams
(74) *Attorney, Agent, or Firm*—Jason A. Bernstein; Powell Goldstein LLP

(57) ABSTRACT

A foldable beverage container formed from a single blank without adhesives, comprising a pair of vertical divider panels, each panel having at least one aperture forming a handle, a horizontal score, and a ledge extending from both sides of the panel. Foldably associated with each divider panel is a bottom panel for supporting the beverage container. Foldably associated with each bottom panel is a side wall panel. Foldably extending from each side wall panel is a pair of mirror image transverse support members. The transverse members preferably have at least one arcuate portion capable of partially holding a cup or other object. Each transverse member has a middle support member having a notch therein which can receive the divider panels and to restrict sideways movement of the divider panels. The carrier can be designed to accommodate a number of containers by modifying the width of the blank.

7 Claims, 10 Drawing Sheets

FOLDABLE BEVERAGE CARRIER

FIELD OF THE INVENTION

The present invention relates to corrugated fiberboard beverage containers. More particularly, the present invention relates to a foldable beverage container and carrier that is not glued together.

BACKGROUND OF THE INVENTION

Beverages and their containers purchased at "fast food" locations, such as at stadiums and amusement parks need to be transported, usually with other food items, from the purchase counter to one's seat nearby. Fast food counter service personnel are usually rushed to get the beverages and food from the preparation area to the purchaser, often with large numbers of people in line behind the purchaser. Because one may purchase beverages for several people at once the need for transporting without spilling the drinks has spawned the creation of many different container carrier designs.

U.S. Pat. No. 6,230,882, issued to Wischusen, discloses a carrier for drink cups with internal support for carrying multiple cups.

U.S. Pat. Nos. 5,738,217 and 5,927,502, issued to Hunter, disclose a combined food and beverage container holder U.S. Pat. No. 6,230,881, issued to Collura, discloses a bottle carrier created from two folded blanks.

U.S. Pat. No. 4,979,657, issued to Espiritu, discloses a portable beverage container for an automotive vehicle and hung from a hook on the dashboard.

U.S. Pat. No. 4,678,154, issued to McFarland, discloses holder designed for use between adjacent car seat cushions.

U.S. Pat. No. 6,536,656, issued to Auclair et al, discloses a carton for packaging bottles.

U.S. Pat. No. 6,457,772, issued to Fortson, discloses a food and beverage holder attachable to a stadium seat.

There is a need for a beverage carrier that can be formed from a single blank without the need for gluing. Assemblage of such a beverage carrier should be quick, easy, and manageable by an untrained individual and in a limited amount of space. Further, the carrier should be available in a stack that is easily refillable, particularly during busy times. Moreover, the carrier must be strong enough to support the larger sizes of beverage containers, which may weigh several pounds each when filled, yet be provided in an unassembled condition as a flat article, preferably in a stack. Such a stack should be easily insertable into an area for holding the carriers until ready for assembly and use.

SUMMARY OF THE INVENTION

The present invention provides a beverage container holder formed from a single blank preferably of corrugated board which can be assembled by folding along pre-scored lines and without the need for glue. Generally described, the present invention provides in a first exemplary embodiment a pair of vertical divider panels, each panel having at least one aperture forming a handle, and a ledge on either one or, preferably, both sides of the panel. Foldably associated with each divider panel is a bottom panel for supporting the beverage container. Foldably associated with each bottom panel is a side wall panel. Foldably extending from each side wall panel is a pair of mirror image transverse support members. The transverse members preferably have at least one arcuate portion capable of partially holding a cup. Each transverse member has a middle support member having a notch defined therein for receiving the divider panels and to restrict sideways movement of the divider panels. The carrier can be designed to accommodate a number of containers by modifying the width of the blank.

Thus, it is a feature of the present invention to provide a carrier that can be constructed from a single blank without glue.

It is a feature of the present invention to provide a carrier that is simple and quick to assemble.

It is a feature of the present invention to provide a carrier that, in an unfolded form, is stackable and easily transported.

Other features and advantages of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION OF THE INVENTION CONSTRUCTION

Figure 1:
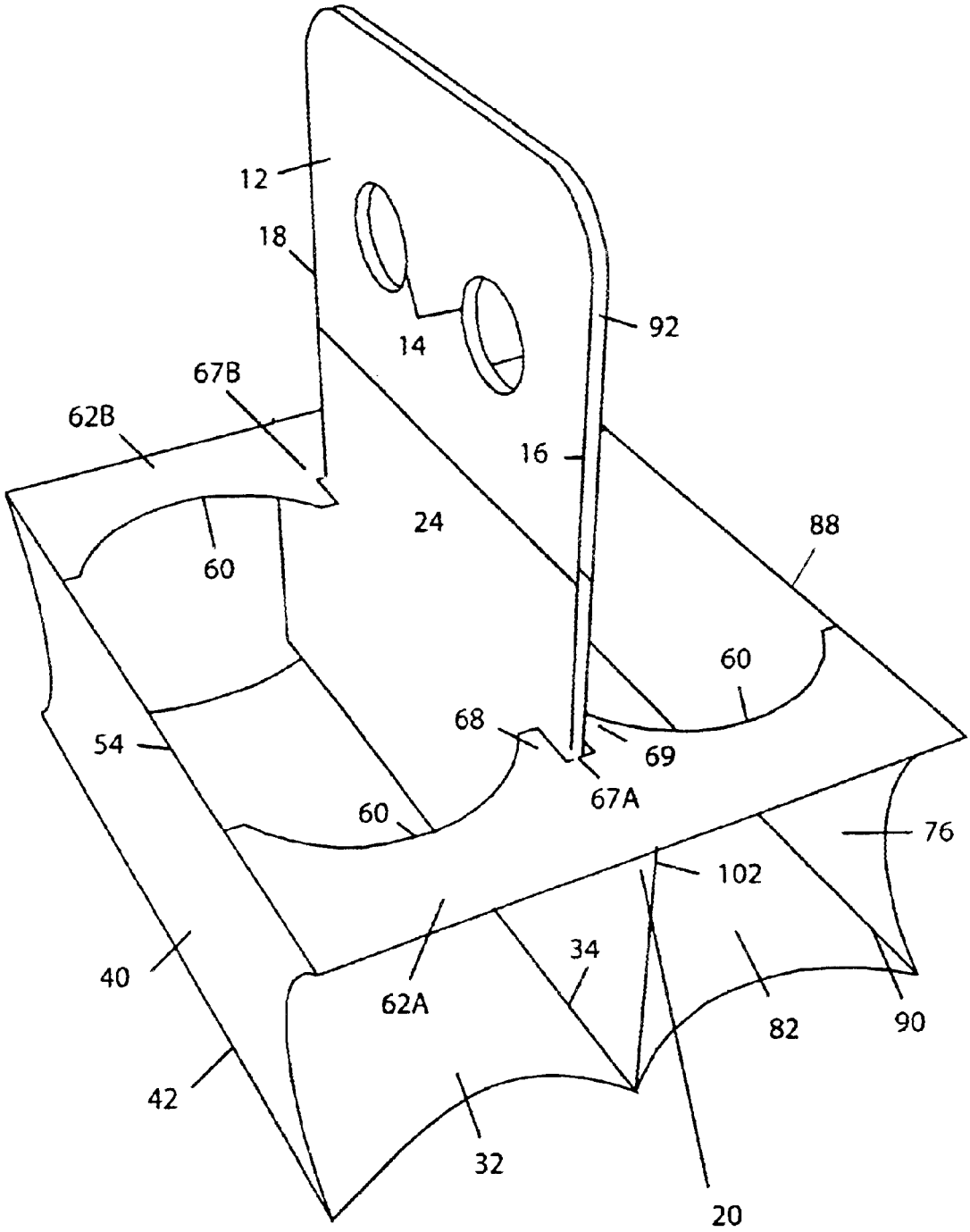
FIG. 1 is pictorial view of an assembled carrier of one exemplary embodiment of the present invention.

FIGS. 1–4 show one exemplary embodiment of a carrier 10 of the present invention. FIG. 1 shows a fully assembled carrier 10. The carrier 10 is preferably composed of a generally flat material having some rigidity and being capable of being bent or scored to facilitate bending along determined lines. A preferred material is corrugated cardboard, such as, but not limited to, CBE and F flutes, commercially available from Pratt Industries (U.S.A.) Inc. (Conyers, Ga.). The material may be coated, such as to provide increased water or fluid resistance and may have paperboard, printing on selected portions of the material.

Alternatively, the carrier may be composed of chipboard, plywood, SBS, metal, plastic, paper, fabric, ceramic, polymer, fibers, mesh, screen, wood, composite, mixtures or combinations of the foregoing, or the like. The carrier 10 may be made of one or more layers of one or more of the aforementioned materials.

Where multiple layers of material are used they may be joined, such as, but not limited to, being laminated, glued or otherwise fastened together for increased strength. The carrier 10 is preferably die cut from a single sheet of material. Alternatively, two or more segments of material may be used and joined together. While the carrier 10 material is preferably scored, where a plurality of panels or segments are used they can be joined using hinge or joint mechanisms known to those of ordinary skill in the art. By score, it is meant to include a cut through a portion of the carrier 10 sheet (either a continuous cut or a line of slits, holes or perforations), or a weakened area, or a compressed area on at least one face of the sheet or other technique to permit bending of the material along a preferred line. Scoring or other such techniques to facilitate bending are known to those skilled in the art.

Figure 2:
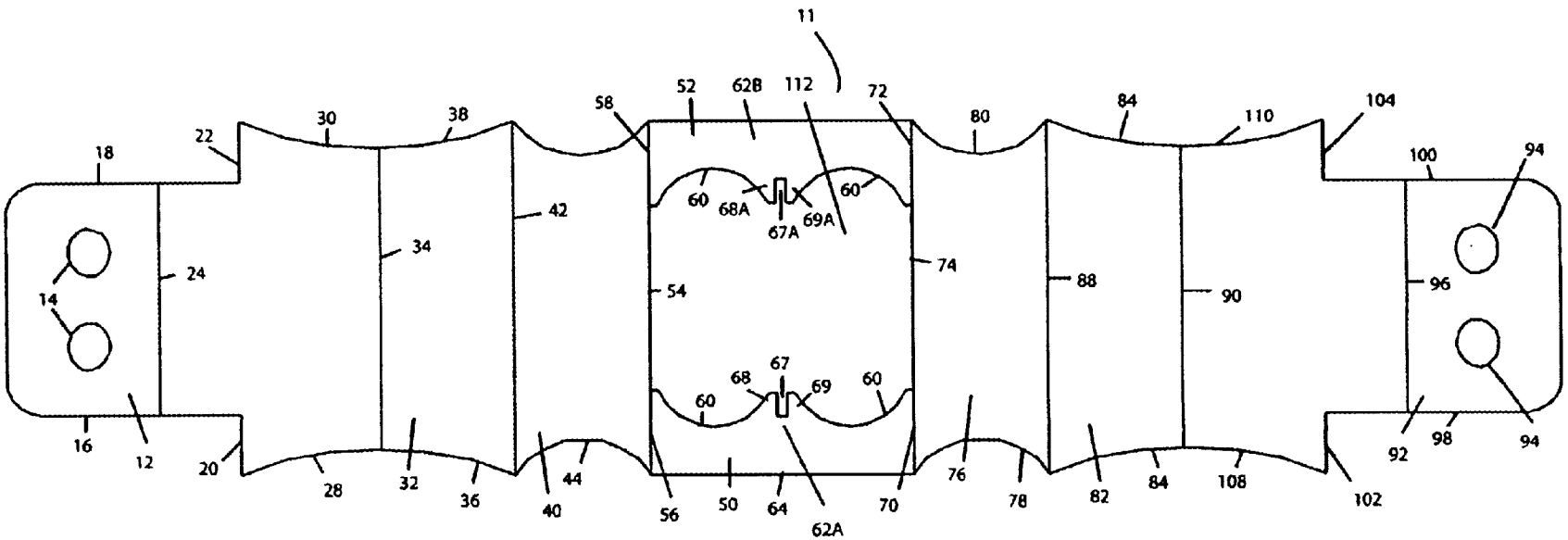
FIG. 2 is a top plan view of the interior surface of a blank from which the carrier of FIG. 1 can be assembled.

FIG. 2 shows a blank 11 having a first divider panel 12 having at least one, and preferably a plurality of apertures 14 to accommodate a user's fingers for carrying, as will be described in detail hereinbelow, a first side 16 and a second side 18. A ledge 20 extends outward from the first side 16 and a ledge 22 extends from the second side 18. The first divider panel 12 has a horizontal score 24. The first divider panel 12 preferably, though not mandatorily, has curved side portions 28 and 30.

A first base panel 32 preferably extends (where the carrier 10 is formed of a sheet of material, or, joined, where several segments of material are hingedly joined together) from the first divider panel 12 and a score 34 is formed therebetween to permit the first base panel 32 and the first divider panel 12 to be flexed, bent or move with respect to one another. The first base panel 32 preferably, though not mandatorily, has curved side portions 36 and 38. Alternatively, the side portions 36 and 38 can be straight, angled or curved in the opposite direction as the curves as shown.

A first side wall panel 40 is associated with the first base panel 32 by a score 42. The first side wall panel 40 preferably, though not mandatorily, has curved side portions 44 and 46.

A first transverse member 50 and a second transverse member 52 are associated with the leading edge 54 of the side wall panel 40 at a foldable first edge 56, 58, respectively. Each transverse member 50, 52 preferably has at least one curved portion 60 which can accommodate a portion of a bottle or other object (not shown). Middle support portions 62A and 62B are located generally midways along the transverse members 50, 52, respectively, as will be described in detail hereinbelow. FIG. 2 shows the middle support portions 62A and 62B as being straight and generally parallel with the first transverse member edge 64, 66 of the transverse members 50, 52. The middle support portion 62A preferably has, in one exemplary embodiment, a notch 67A formed by a finger 68A and a finger 69A. The notch 67A can receive the side 16 of the divider panel 12, as will be described in greater detail hereinbelow. Similarly, the middle support portion 62B preferably has, in one exemplary embodiment, a notch 67B formed by a finger 68B and a finger 69B. The notch 67B can receive the side 100 of the divider panel 92, as will be described in greater detail hereinbelow.

The remaining structure of the blank 11 as viewed in FIG. 2 from the transverse members 50, 52 toward the opposite side from the panel 12 are generally in mirror image to the structural elements described thus far above. Specifically, the second edge 70, 72 of the transverse members 50, 52 are foldably associated at a leading edge 74 of a second base panel 76. The second base panel 76 preferably, though not mandatorily, has curved portions 78, 80. A second side wall panel 82, preferably, though not mandatorily, having curved portions 84, 86 is foldably associated at an edge 88 with the second base panel 76. The second side wall panel 82 is foldably associated at an edge 90 with a second divider panel 92.

Similar to the first divider panel 12, the second divider panel 92 has second divider panel apertures 94, score 96, side edges 98 and 100, side ledges 102, 104, and preferably, though not mandatorily, curved portions 108, 110.

The first and second transverse members 50, 52 and edges 54 and 74 form a receptacle 112 capable of receiving at least one, and preferably a plurality of objects, such as a beverage container.

Folding and Assembly

Figure 3:
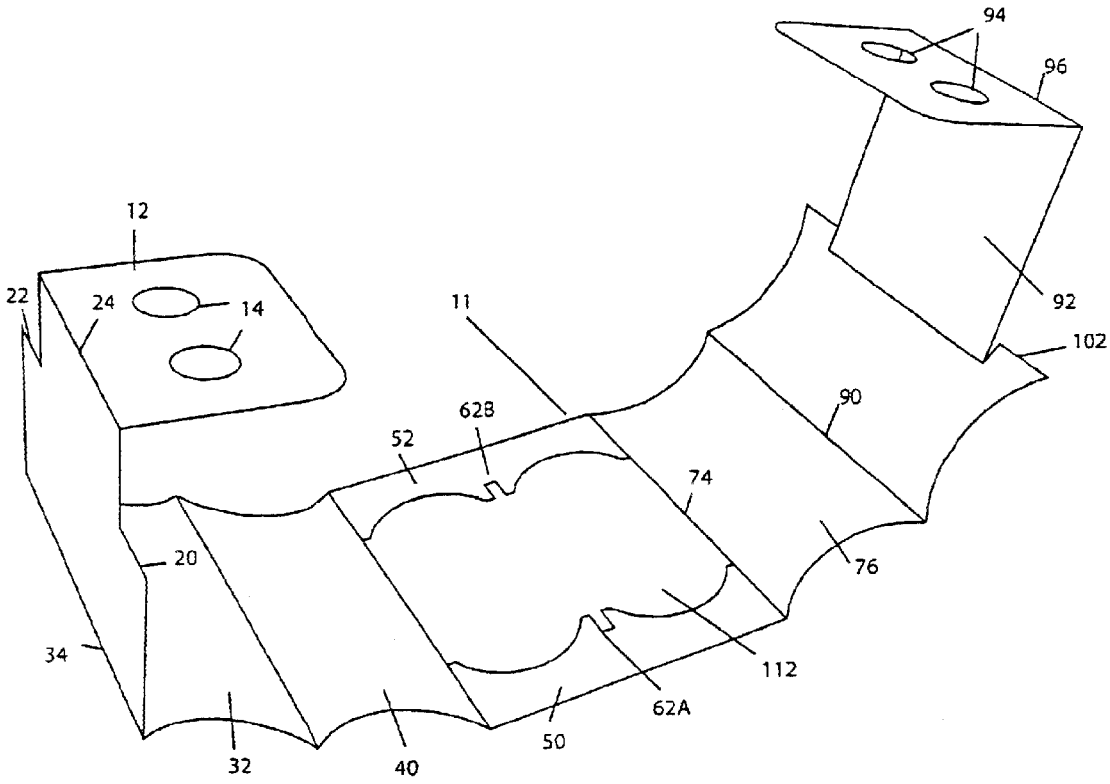
FIG. 3 is pictorial view of the embodiment of FIG. 1 with the divider panels folded.
Figure 4:
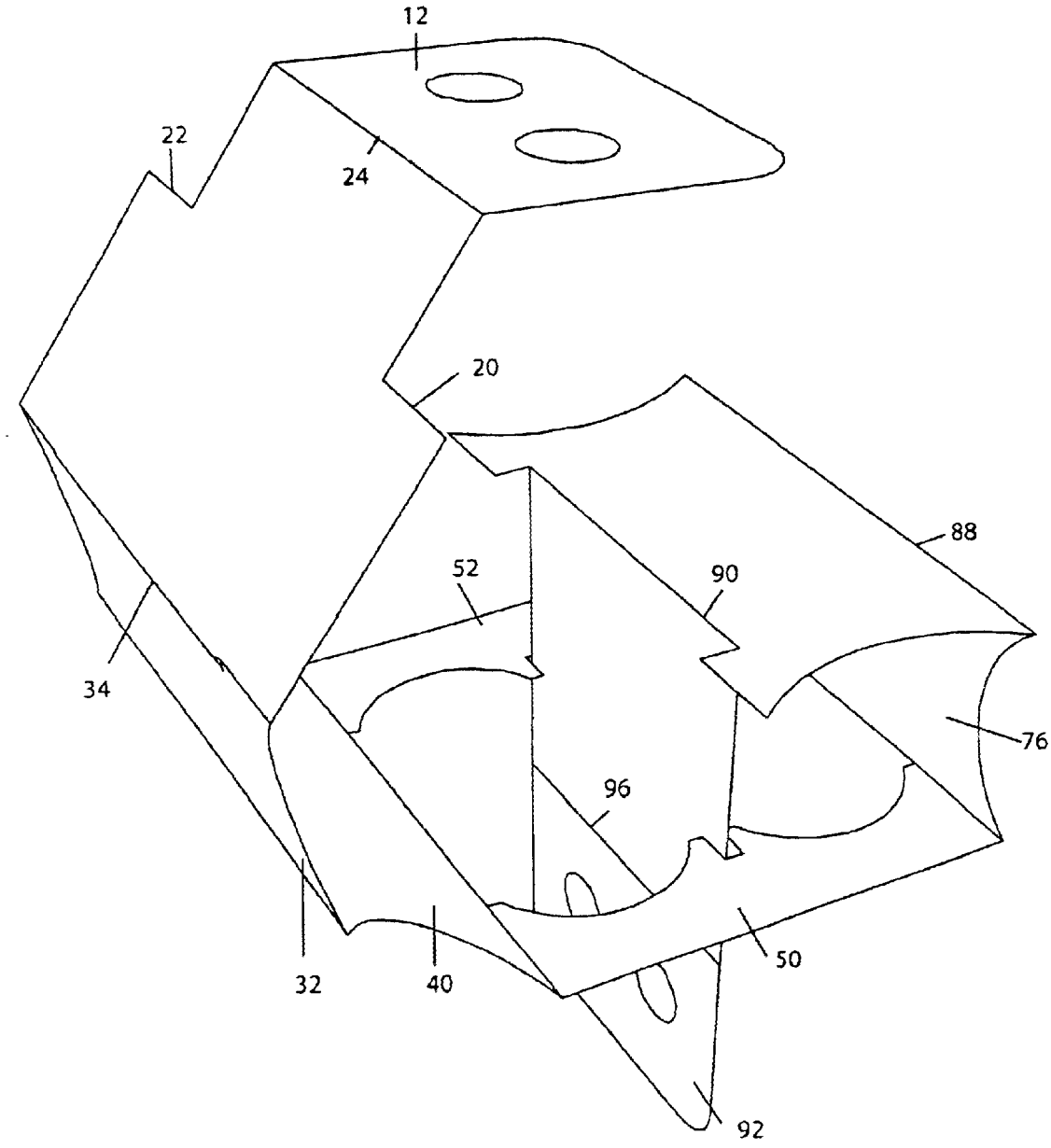
FIG. 4 is pictorial view of the embodiment of FIG. 1 partially assembled with one divider panel folded through the center opening and inserted into the notch in the transverse member.
Figure 5:
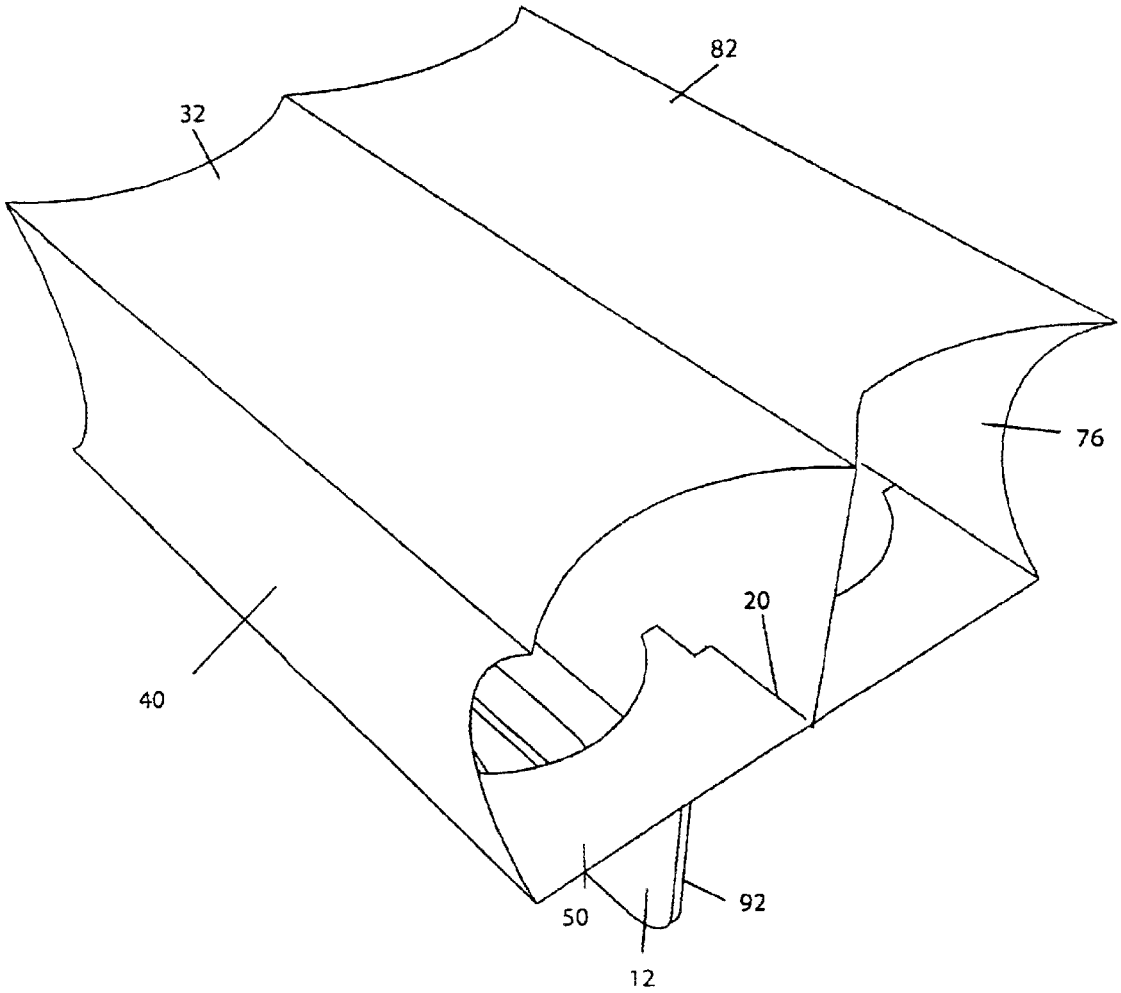
FIG. 5 is a pictorial underside view of an assembled carrier.

Turning to FIGS. 3–5, and particularly FIG. 3, the divider panels 12 and 92 are initially folded along score lines 24, 34 and 90, 96, respectively, towards the center of the receptacle 112. Turning to FIG. 4, the divider panels 12 and 92 are inserted into the receptacle 112 by folding along the score lines 34, 42, 54, 74, 88 and 90 until the ledges 20 and 102 contact the underside of the transverse member 50 and the ledges 22 and 104 contact the underside of the transverse member 52. The sides 16 and 92 of the divider panel 12 are inserted in the notch 67A and the sides 18 and 100 of the divider panel 92 are inserted in the notch 67B. Turning to FIG. 5, the side walls 40 and 76 are generally vertical and perpendicular to the base panels 32 and 82. The divider panels 12 and 92 are generally vertical and parallel with respect to each other and in proximity to each other, preferably adjacently. The ledges 20, 102 and 22, 104 are rest underneath and support the middle support portions 62A and 62B. The assembled carrier 10 as shown in FIG. 4 may, for example, but not by way of limitation, hold four cups in the receptacle 112. Other objects, such as, but not limited to, bottles, food items, bags, other containers, combinations of the foregoing, or the like, may also be held. The weight of the objects is supported by the base panels 12 and 92 and the ledges 20, 102 and 22, 104. The user can grip and carry the carrier 10 by inserting fingers into the apertures 14 and 94.

Figure 6:
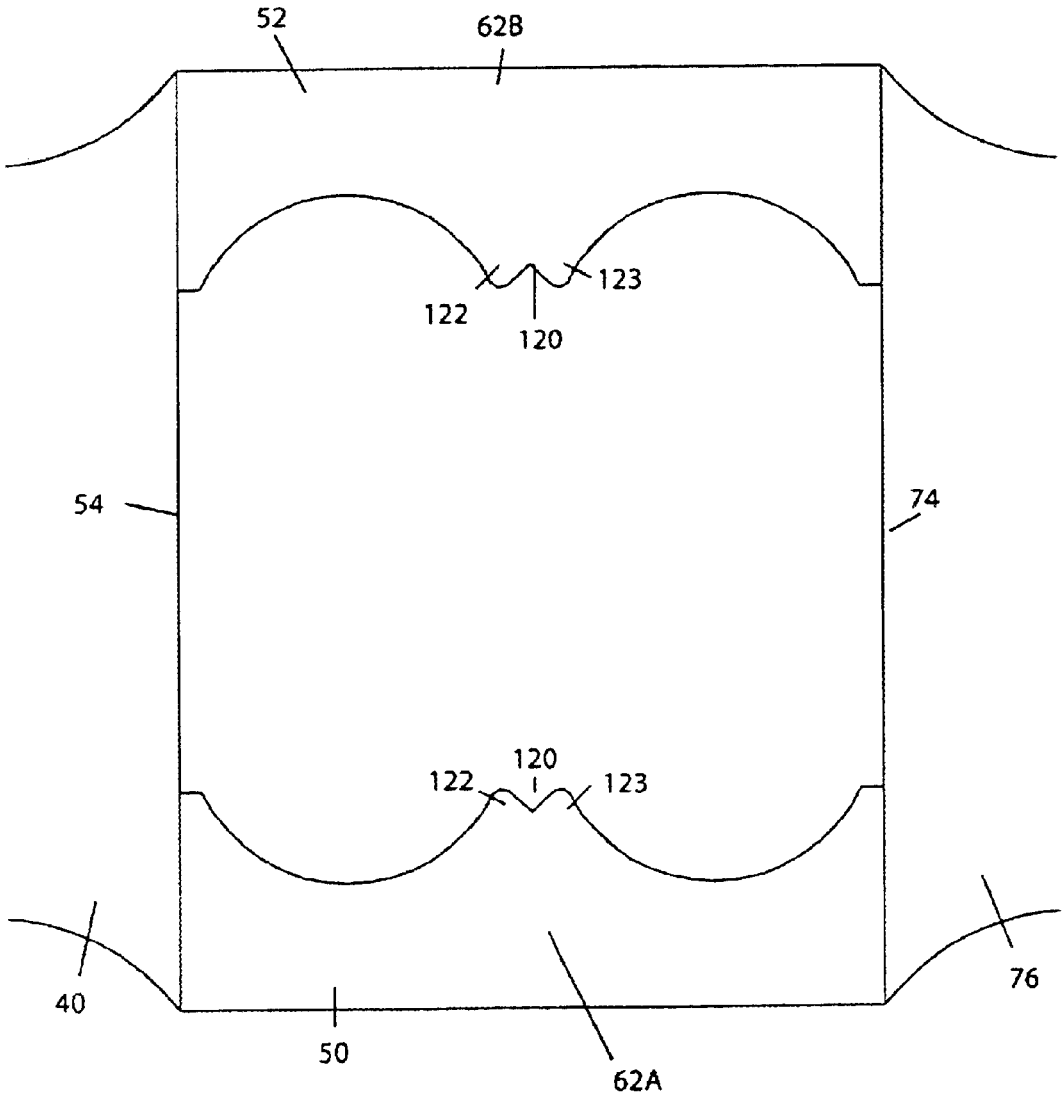
FIG. 6 is a top plan view showing a detail of the transverse member and the middle support member in a first alternative embodiment.
Figure 7:
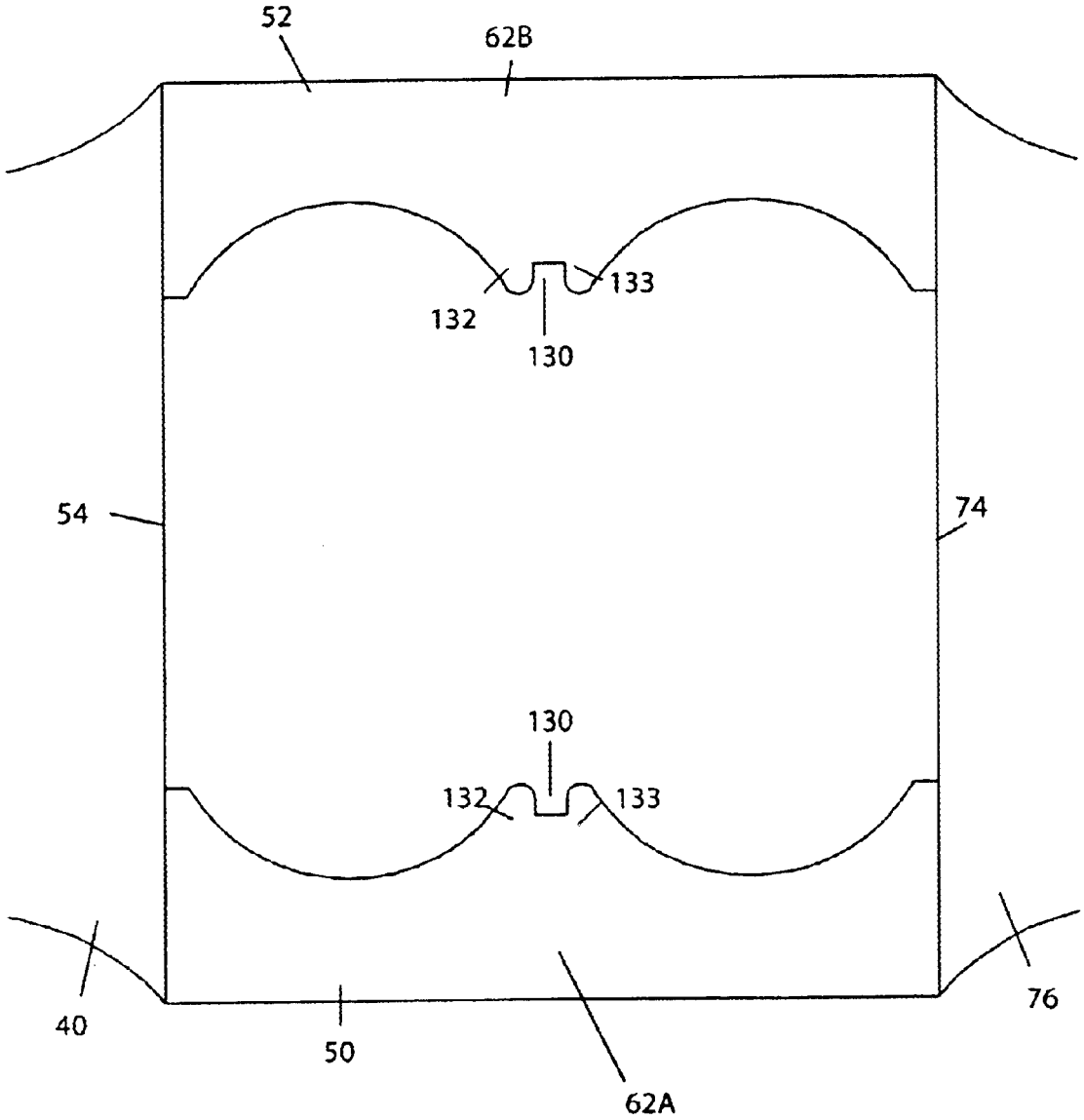
FIG. 7 is a top plan view showing a detail of the transverse member and the middle support member in a second alternative embodiment.

In a first alternative embodiment shown in FIG. 6, the middle support members 62 can have a notch 120 and rounded fingers 122 and 123. In a second alternative embodiment, as shown in FIG. 7, the middle support members 62 may have a notch 130 with a squared off base and rounded fingers 132, 133. The all the notch configurations described above restrict sideways movement of the divider panels 12 and 92, such as if two heavy objects are placed on one side of the receptacle 112 on the same side of one divider panel. The fingers 122 or 124 can be substantially even with the width of the edges 56, 58, 70 and 72, or, be wider, as shown in FIGS. 5 and 6. Other notch shapes, such as rectangular, and the like, are contemplated as being within the scope of the present invention. The fingers of the various embodiments may be scored, bendable or otherwise deformable so that the panels 12, 92 can be fitted over the fingers into the notches.

The carrier 10 described above can be modified to accommodate more objects by widening the structure, i.e., increasing the distance between the transverse members 50 and 52. Optionally, the other corresponding elements of the structure, e.g., side wall panels, bottom panels and divider panels, can also be constructed to be wider. It is to be further understood that the carrier of the present invention can be modified by narrowing the distance between the transverse members 50 and 52 and modifying the distance between the other elements so as to create a single container receptacle on either side of the panels 12 and 92.

As noted above, the curved portions described for the panels can be straight, beveled, curved or shaped in other lines geometries.

Figure 8:
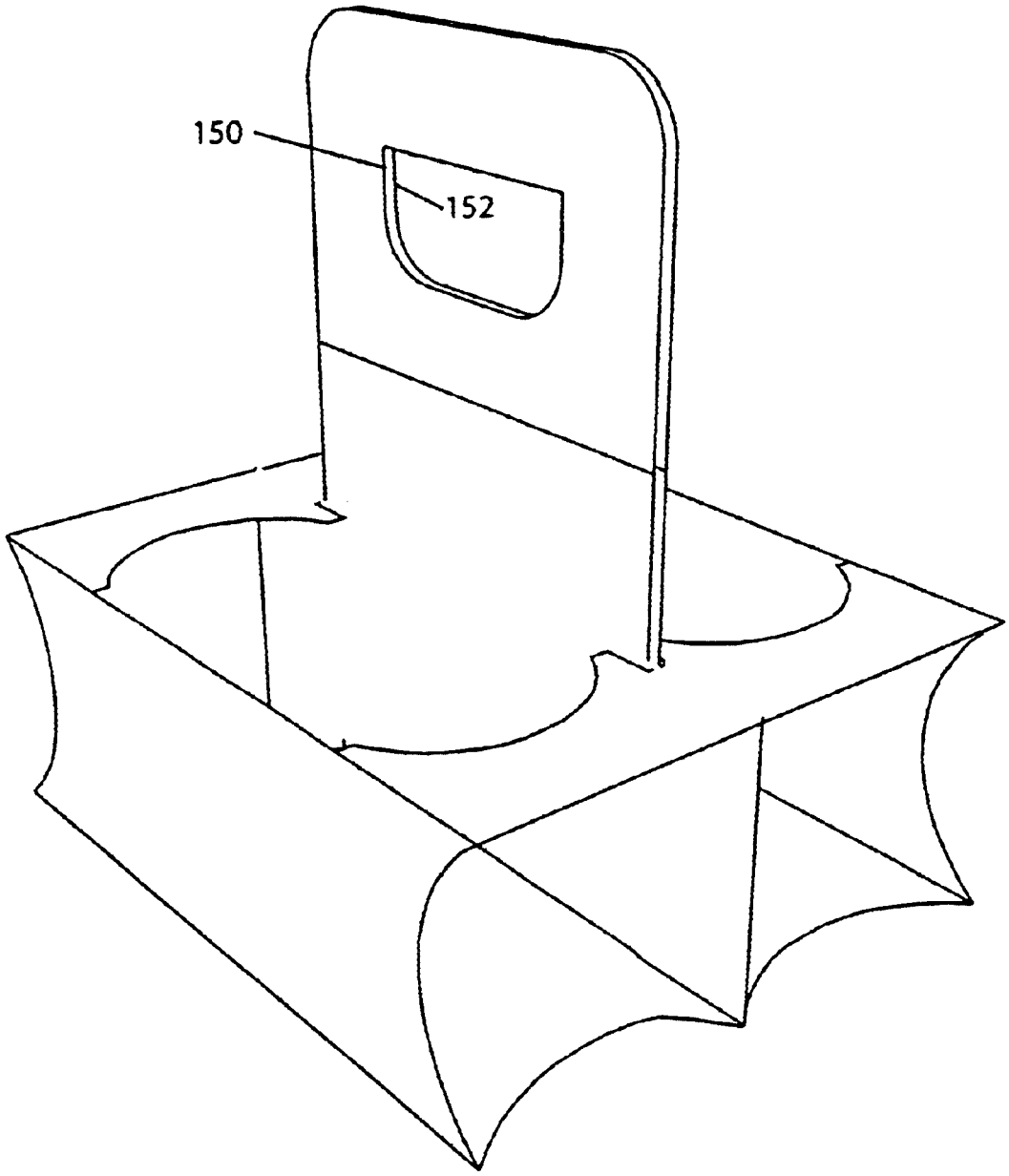
FIG. 8 is a pictorial view showing a detail of the handle area according to a third alternative embodiment.

In a third alternative embodiment, shown in FIG. 8, the apertures 14 may instead be a single slot 150, and the apertures 94 can be a single slot 152, so as to accommodate a greater number of fingers or part of the hand.

Figure 9:
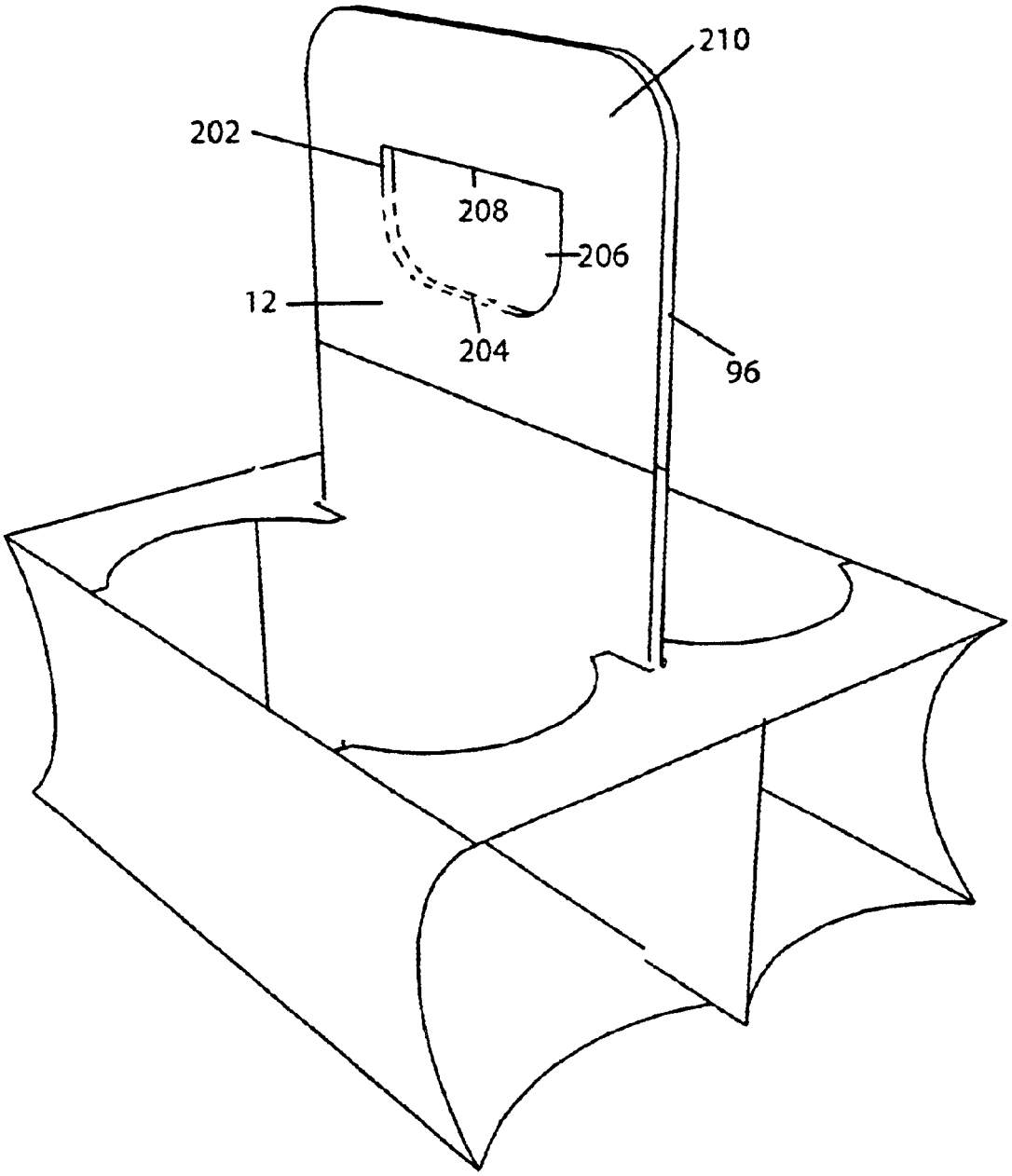
FIG. 9 is a pictorial view showing a detail of the handle area with a scored handle
Figure 10:
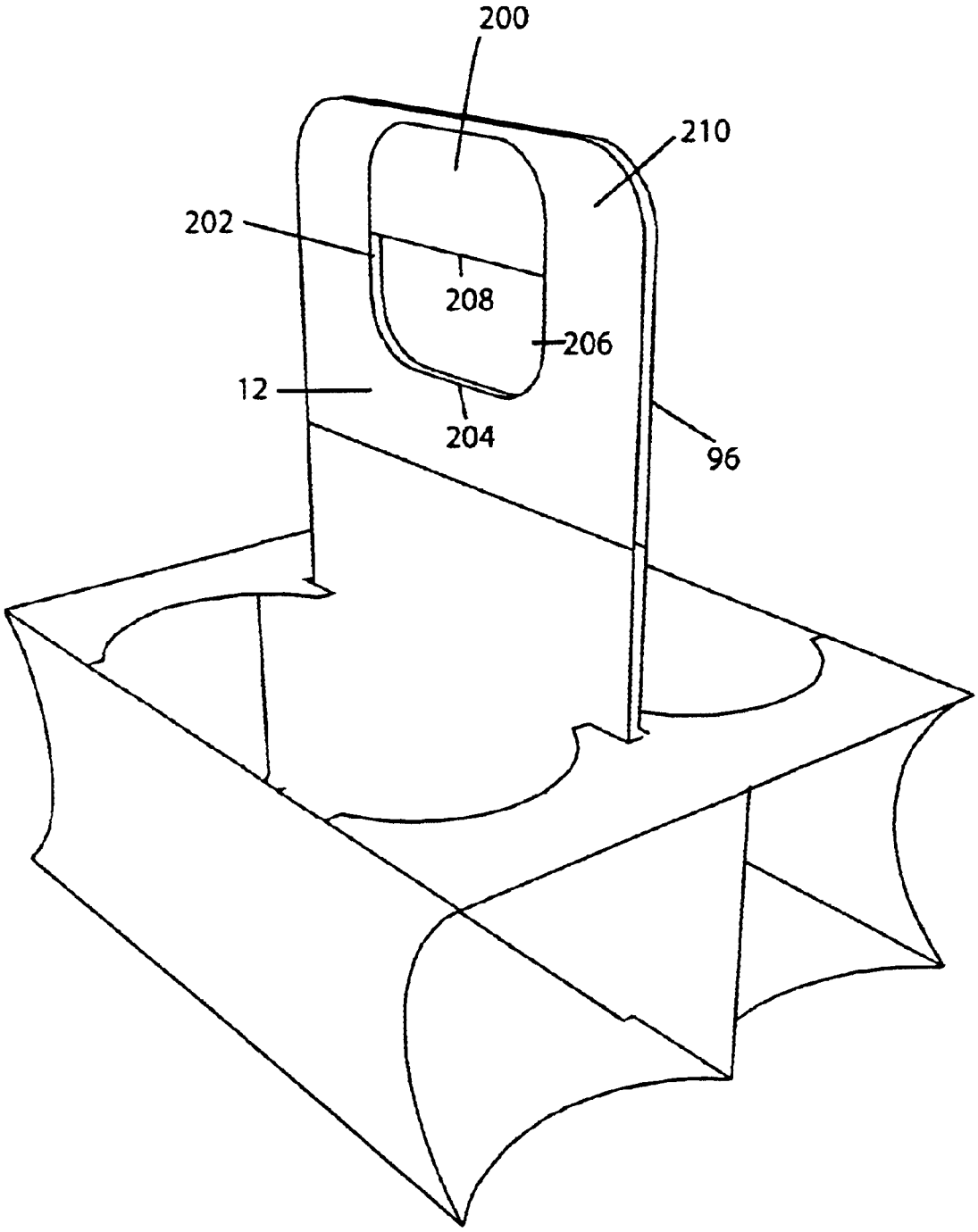
FIG. 10 is a pictorial view showing a detail of the handle area of FIG. 9 with the flap folded upward.

In a fourth embodiment, shown in FIG. 9, the panel 12 can have a partially cut flap 200 formed by cutting at least part way through three sides 202, 204 and 206 of the flap (shown in dashes in FIG. 8) and leaving a scored or unscored top portion 208. When the carrier 10 is assembled, as shown in FIG. 10, the flap 200 is folded upward to form a handle area 210. This embodiment may strengthen the handle 210 and also restrict side-to-side relative movement of the panels 12 and 96. The flap 200 can be in either panel 12 or 96 (with the other panel not having the flap having an open slot) or in both panels. The increased width of the flap 200 and the rounded edge of the folded flap 200 may also enhance comfort while carrying.

An advantage of the present invention is that it can be formed from a single die cut form at low cost. It is designed to be disposable after a single use. Another advantage is that no glue or other adhesive or fastening means is required to assemble the carrier 10, thus reducing the number of manufacturing steps and associated cost. The carrier 10 is simple and fast to fold, making is particularly useful in fast food establishments, particularly at a stadium, where fast assembly of various food and drink items require an easy-to-use carrier. Another advantage is that the carrier is provided flat and a large number takes up relatively little space. The carrier of the present invention is ready for immediate folding and use by removing one from a stack. There is also relatively minimal waste during manufacture of the present invention because the overall shape of the carrier is generally rectangular and a number can be cut close together from base material with little extra unused material. Additionally, the side wall panels 40 and 76, as well as the divider panels 12 and 96 are conveniently able to have advertising or promotional displays printed or otherwise formed thercon. The height of the divider panels 12 and 96 can be modified to incorporate more advertising display area.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It should further be noted that any patents, applications and publications referred to herein are incorporated by reference in their entirety.

What is claimed is:

1. A beverage container carrier, comprising:

a) a plurality of vertical divider panels, each panel having
  i) a first side and a second side,
  ii) a first ledge extending from said first side,
  iii) a second ledge extending from said second side, b) a plurality of base panels flexibly attached to said divider panels;

c) a plurality of side wall panels flexibly attached to said base panels;

d) a plurality of transverse support members, each transverse support member having,
  i) a first end flexibly attached to one of said plurality of side wall panels,
  ii) a second end flexibly attached to one of said plurality of side wall panels,
  iii) a middle support portion disposed generally midways between said first end and said second end, and having a notch defined therein; and, e) at least one receptacle formed by said transverse support members and said base panels.

2. The carrier of claim 1, further comprising at least one aperture forming a handle in each vertical divider panel.

3. The carrier of claim 1, wherein said divider panels are slidingly received within said notch in said middle support portion.

4. The carrier of claim 1, wherein each divider panel has a portion of said first and second sides being arcuate.

5. The carrier of claim 1, wherein each base panel has a first and second sides being arcuate.

6. The carrier of claim 1, wherein each side wall panel has a first and second sides being arcuate.

7. The carrier of claim 1, wherein said middle support portion has at least one arcuate section.

* * * * *